US008292709B2

(12) United States Patent
Welch

(10) Patent No.: US 8,292,709 B2
(45) Date of Patent: Oct. 23, 2012

(54) SPORTS GAME APPARATUS AND METHOD

(76) Inventor: Richard Bruce Welch, London (GB)

( * ) Notice: Subject to any disclaimer, the term of this patent is extended or adjusted under 35 U.S.C. 154(b) by 814 days.

(21) Appl. No.: 11/875,348

(22) Filed: Oct. 19, 2007

(65) Prior Publication Data

US 2008/0153634 A1 Jun. 26, 2008

(30) Foreign Application Priority Data

Apr. 20, 2005 (GB) ..... 0507991.8

(51) Int. Cl.
*A63F 13/12* (2006.01)

(52) U.S. Cl. ..... 463/7; 463/3; 463/30; 463/36; 273/108.3; 273/244.1; 273/317.6; 273/317.7; 377/5; 446/415; 473/451; 473/468

(58) Field of Classification Search ..... 463/1–9, 463/20, 23, 25, 30–32, 34, 36–37, 40–43, 463/46–47, 50, 53, 56; 273/108.1, 108.3, 273/108.4, 118 R, 150, 244, 244.1, 247, 259, 273/317.1, 317.3, 317.4, 317.5, 317.6, 359, 273/406, 440.1, 460–461; 340/323 R, 323 B; 377/4–5; 446/415; 473/451, 468, 498–499, 473/504, 564–565, 598, 600, FOR. 102, FOR. 135, 473/FOR. 169, FOR. 192; *A63F 13/12*
See application file for complete search history.

(56) References Cited

U.S. PATENT DOCUMENTS 3,698,712 A * 10/1972 Pero ..... 473/454
4,304,406 A * 12/1981 Cromarty ..... 473/225
4,534,557 A * 8/1985 Bigelow et al. ..... 473/442
4,855,711 A * 8/1989 Harrop et al. ..... 473/467
4,872,674 A * 10/1989 Deal ..... 473/435
4,915,384 A 4/1990 Bear et al.
5,059,944 A * 10/1991 Carmona ..... 473/467
5,082,262 A * 1/1992 Sanchez ..... 473/458
5,171,012 A * 12/1992 Dooley ..... 463/2
5,174,759 A * 12/1992 Preston et al. ..... 434/317
5,354,063 A * 10/1994 Curchod ..... 473/156
5,390,927 A * 2/1995 Angelos ..... 473/155
5,401,018 A * 3/1995 Kelly et al. ..... 473/430
5,419,562 A * 5/1995 Cromarty ..... 473/269
5,419,565 A * 5/1995 Gordon et al. ..... 473/455

(Continued)

FOREIGN PATENT DOCUMENTS

WO WO 02074397 A1 * 9/2002

OTHER PUBLICATIONS

Newgy, Robo Pong Table Tennis, Ping Pong Robot Pongmaster Game, 2000, Robbins Table Tennis Specialties, Inc., pp. 1-3.*

*Primary Examiner* — Arthur O. Hall
(74) *Attorney, Agent, or Firm* — Baker Botts LLP

(57) ABSTRACT

There is described an apparatus for a sports game involving movement of a projectile, the apparatus comprising impact sensors for detecting impacts by a player of the sport game or the projectile, the impact sensors being coupled to a processor operable to derive characteristic data for a projectile movement from impacts detected by two or more of the player impact sensors. By monitoring impacts, rather than the movement of the projectile through the air, the apparatus may be both inexpensive and easy to install.

25 Claims, 7 Drawing Sheets

U.S. PATENT DOCUMENTS 5,472,205 A * 12/1995 Bouton ..... 473/222
5,566,934 A * 10/1996 Black et al. ..... 473/431
5,697,791 A * 12/1997 Nashner et al. ..... 434/247
5,757,266 A 5/1998 Rider et al.
5,798,703 A * 8/1998 Sakai et al. ..... 340/666
5,820,496 A * 10/1998 Bergeron ..... 473/455
5,868,578 A * 2/1999 Baum ..... 434/247
5,988,646 A * 11/1999 Fair ..... 273/371
5,988,861 A * 11/1999 Baum ..... 702/142
6,605,011 B1 * 8/2003 Yamamoto et al. ..... 473/455
6,709,351 B2 * 3/2004 Hori ..... 473/455
6,837,495 B2 * 1/2005 Gerson et al. ..... 273/372
7,052,391 B1 * 5/2006 Luciano, Jr. ..... 463/3
7,084,888 B2 * 8/2006 Takahama et al. ..... 345/649
7,722,465 B2 * 5/2010 Sumi ..... 463/31
7,789,742 B1 * 9/2010 Murdock et al. ..... 463/3
2003/0047001 A1 3/2003 Liao
2005/0119036 A1 * 6/2005 Albanna et al. ..... 463/7
2005/0245302 A1 * 11/2005 Bathiche et al. ..... 463/1
2006/0166737 A1 * 7/2006 Bentley ..... 463/30
2006/0180647 A1 * 8/2006 Hansen ..... 235/375
2006/0189386 A1 * 8/2006 Rosenberg ..... 463/37
2007/0200298 A1 * 8/2007 Course ..... 273/317.5
2008/0200285 A1 * 8/2008 Haseth ..... 473/422

* cited by examiner

SPORTS GAME APPARATUS AND METHOD

CROSS-REFERENCE TO RELATED APPLICATIONS

This application is a continuation of International Application PCT/GB06/001189, filed Mar. 31, 2006, which claims the benefit of Great Britain Application No. 0507991.8, filed Apr. 20, 2005, each of which is incorporated by reference in its entirety herein.

This invention relates to apparatus associated with a sport game. It has particular, but not exclusive, relevance to a cricket game.

A problem with cricket games, as well as other games, is how to record automatically data representative of a ball delivery to allow for future analysis. In recent years, the Hawkeye system (which is generally described in PCT Patent Application WO 01/03781) has been used by television companies and the like to analyse ball deliveries and provide virtual television replays. In the Hawkeye system, multiple cameras record a cricket ball delivery from respective different orientations allowing trajectory information, including a three-dimensional flight path, for the delivery to be calculated.

The Hawkeye system has the problems that it is expensive and requires the precision alignment of many cameras, which is a time-consuming process. These problems are exacerbated in the context of "nets" sessions in which two or more batsmen play deliveries in respective netted enclosures or in compact training areas where cameras cannot be appropriately sited.

An aim of the present invention is to provide an alternative sports game apparatus for deriving projectile trajectory data which is better suited to use by small sporting clubs and the like.

According to the present invention, there is provided apparatus for a sport game involving movement of a projectile, the apparatus comprising impact sensors for detecting impacts by a player of the sport game or the projectile, the impact sensors being coupled to a processor operable to derive characteristic data for a projectile movement from impacts detected by two or more of the planar impact sensors. By monitoring impacts, rather than the movement of the projectile through the air, the apparatus may be both inexpensive and easy to install.

Preferably, the impact sensors are planar because this allows for easier integration into existing sports facilities and also compact storage.

Various embodiments of the invention will now be described with reference to the attached Figures in which:

FIG. 1 schematically shows a perspective view of a cricket net practice system according to the present invention;

FIGS. 2A and 2B schematically show views of a cricket bat sensor forming part of the system illustrated in FIG. 1;

FIGS. 3A and 3B schematically show views of a cricket pad sensor forming part of the system illustrated in FIG. 1;

FIGS. 4A and 4B schematically show views of a cricket stump sensor forming part of the system illustrated in FIG. 1;

First Embodiment

Figure 1:
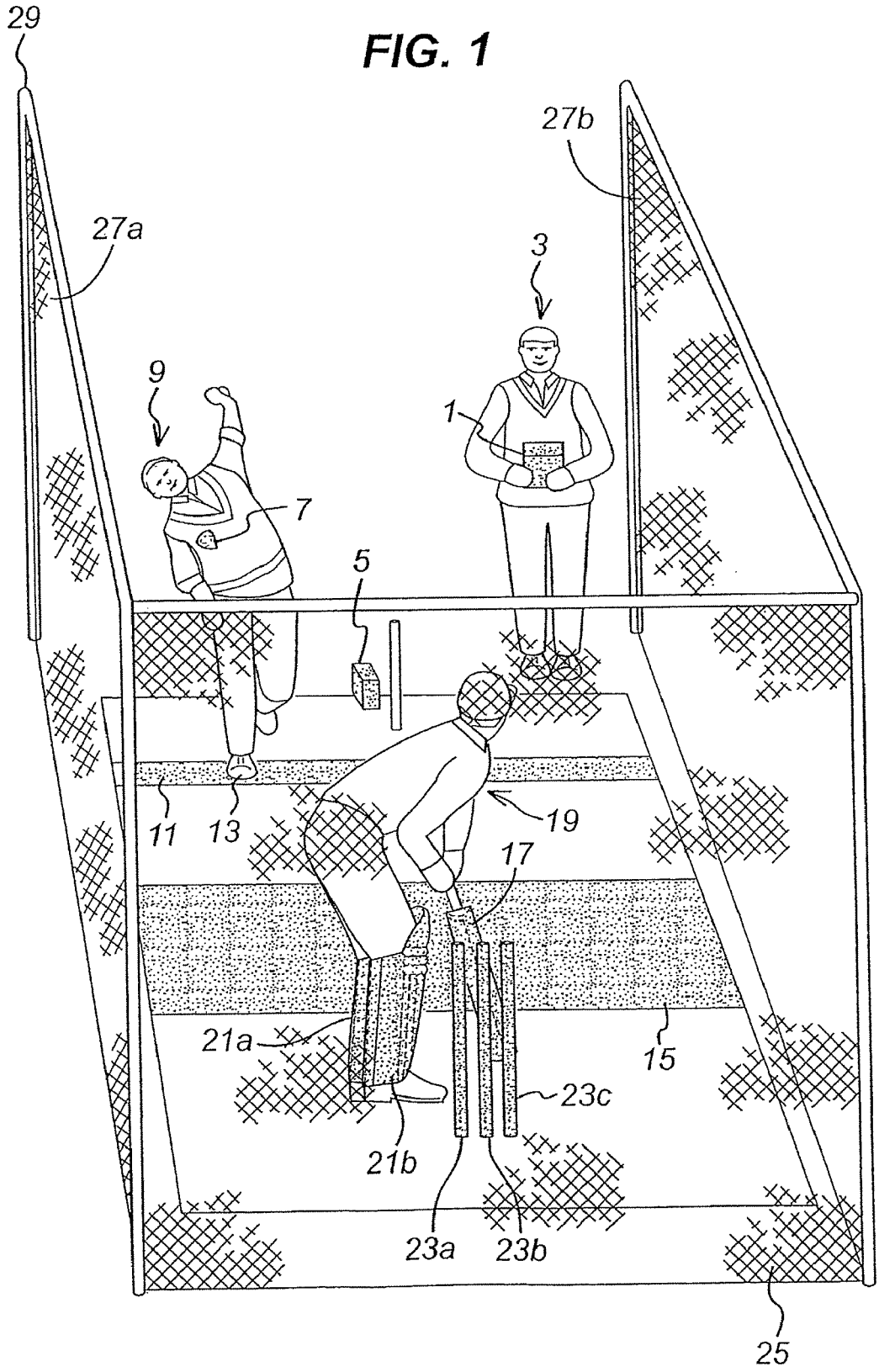

As shown in FIG. 1, in the first embodiment of the invention conventional cricket net apparatus is modified to include a plurality of sensors which provide information about a delivery to a coaching assistant apparatus 1 for review by a coach 3. In particular, the plurality of sensors include:

- an RFID tag sensor 5 provided at the bowler's end of the batting strip (i.e. the area between the bowler's wicket and the batsman's wicket) which detects an RFID tag 7 worn by a bowler 9;
- a crease sensor 11 placed on the batting strip at the bowler's end to detect the impact of the front foot 13 of the bowler 9 when making a delivery;
- a pitch sensor 15 extending over the middle of the batting strip for detecting the impact of the cricket ball on the batting strip during a delivery;
- a bat sensor 17 covering the cricket bat of the batsman 19;
- left and right pad sensors 21*a*, 21*b* covering the cricket pads of the batsman 19;
- left, middle and right stump sensors 23*a*, 23*b*, 23*c* covering the cricket stumps at the batsman's end of the pitch;
- a back stop sensor 25 vertically arranged behind the batsman; and
- left and right wall sensors 27*a*, 27*b* vertically arranged to the left-hand side and right-hand side of the pitch respectively.

In this embodiment, apart from the RFID tag sensor 5 the remaining sensors are ElekTex cloth sensors which are available from Eleksen Limited, an English company having a place of business at Pinewood Studios, Pinewood Road, Iver Heath, Buckinghamshire, UK. An Elektex cloth sensor has at least two conductive layers which are separated by a central layer which allows conduction between the conductive layers when compressed. Further details of such a cloth sensor may be found in U.S. Pat. No. 6,714,117, whose whole contents are hereby incorporated by reference.

Elektek cloth sensors have a number of mechanical properties which make them suited to the present invention. These mechanical properties include being lightweight (which is convenient for storage and portability), hard-wearing (which is required due to absorb the repeated impacts of the bowler and cricket ball), waterproof (which allows both indoor and outdoor use), and flexible (which allows the cloth sensors to be bent around objects such as cricket bats and cricket stumps. Further, the co-ordinate resolution of less than a centimeter is more than adequate for the invention.

In this embodiment, each cloth sensor has associated processing circuitry which monitors the cloth sensor and in response to an impact sends a signal conveying the impact co-ordinates, the impact pressure and the impact timing to the coaching assistant apparatus 1 via a wireless communication apparatus (not shown in FIG. 1) using the Bluetooth protocol. All the cloth sensors are also able to communicate with each other, and the RFID tag sensor 7, using the Bluetooth protocol in order to achieve time synchronisation.

The RFID tag sensor 5 is conventional and is able to identify the closest of a plurality of RFID tags 7. Each bowler 9 is given a respective different RFID tag 7 so that by sensing the nearest RFID tag 7 when a bowler 9 delivers a ball the identity of the bowler may be detected and logged by the coaching assistant apparatus 1.

In this embodiment, the batting strip is grass and the crease sensor 11 and the pitch sensor 15 are secured in position by small pegs (not shown). The crease sensor 11 and the pitch sensor 15 have markings thereon (not shown) which facilitate alignment with the stumps and the crease lines at each end. The back stop sensor 25 and the left-hand and right-hand wall sensors 27*a*, 27*b* are hung from a conventional frame 29 in place of nets.

Figure 2A:
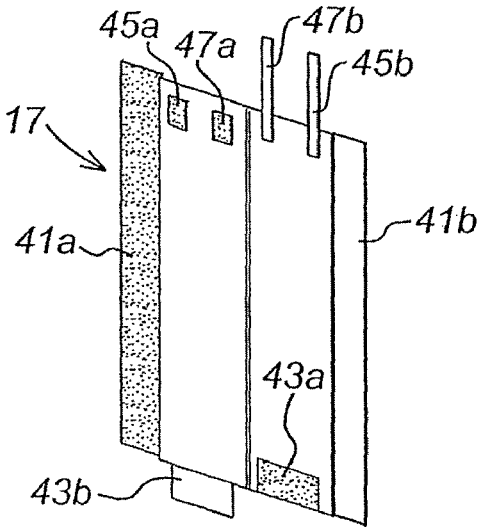
Figure 2B:
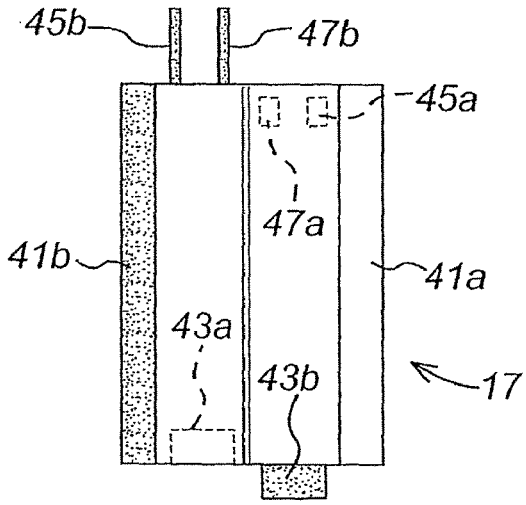

As shown in FIGS. 2A and 2B, the bat sensor 17 is formed by a cloth sensor which wraps around the cricket bat and is secured behind the bat by a hook-and-eye fastener 41*a*, 41*b* such as Velcro. A further hook-and-eye fastener 43*a*, 43*b* is provided to secure around the bottom tip of the bat, and two separate hook-and-eye fasteners 45*a*, 45*b* and 47*a*, 47*b* are provided to secure around the handle of the bat.

Figure 3A:
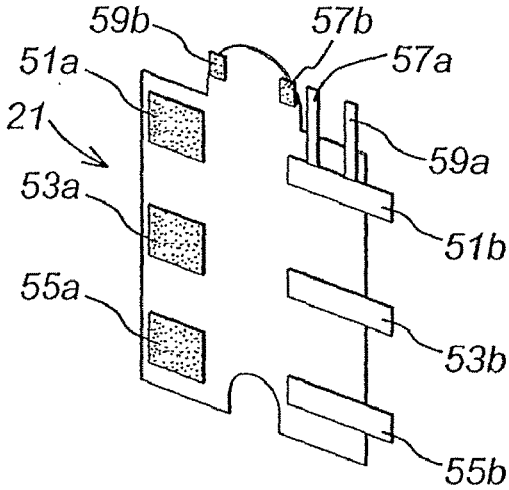
Figure 3B:
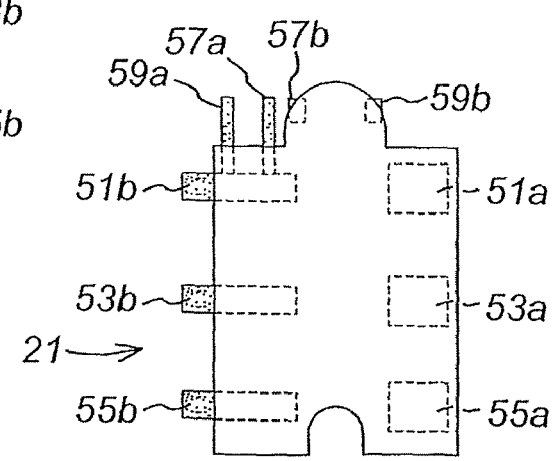

As shown in FIGS. 3A and 3B, each pad sensor 21 is formed by a cloth sensor which wraps around the pad and is secured by three hook-and-eye fasteners 51*a*, 51*b*, 53*a*, 53*b* and 55*a*, 55*b* around the back of the pad. Further hook-and-eye fasteners 57*a*, 57*b* and 59*a*, 59*b* are provided to secure around the top of the pad.

Figure 4A:
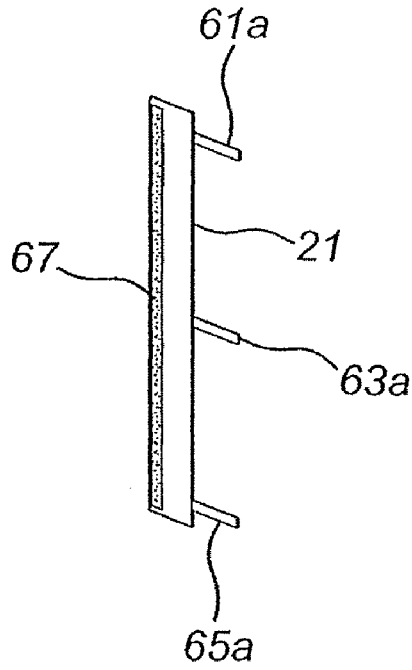
Figure 4B:
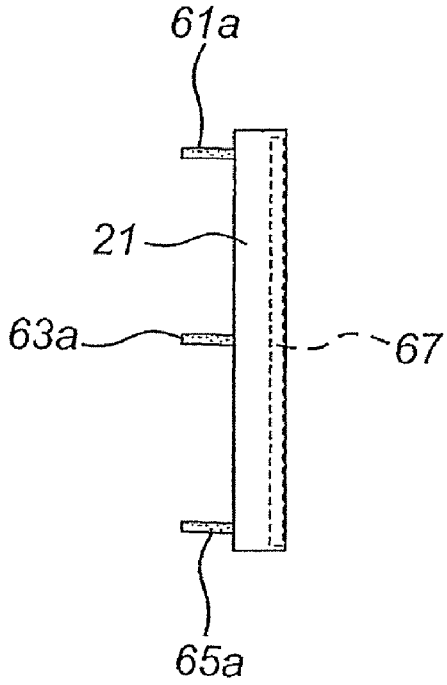

As shown in FIGS. 4A and 4B, each stump sensor 23 is formed by a strip of cloth sensor which is wrapped around a stump and secured by three hook fasteners 61, 63 and 65 at different positions around the stump which engage a single eye fastener provided along the length of the stump.

As discussed above and shown in FIG. 5, in this embodiment the RFID Tag Sensor 7 and the various impact sensors are each connected to a respective different wireless communication apparatus 71 which transmits sensor readings to a wireless communication apparatus 73 provided in the coaching assistant apparatus 1 using the Bluetooth protocol.

In the coaching assistant apparatus 1, the wireless communication apparatus 73 is connected to a data bus system 75. The coaching assistant apparatus also includes an operator interface 77, a remote device interface 79, a processor 81, database memory 83, program routine memory 85 and volatile memory 87, all of which are interconnected by the data bus system 75. Although the database memory 83, the program routine memory 85 and the volatile memory 87 are schematically represented as separate memories in FIG. 5, it will be appreciated that they are in practice different memory regions of the coaching assistant apparatus 1 which may form part of a common memory device such as a hard disk.

In this embodiment, the operator interface 77 includes a keyboard for allowing the operator to enter data into the coaching assistant apparatus 1 and a display for allowing the operator to read data from the coaching assistant apparatus 1. The operator interface 77 also includes a CD-ROM reader/writer via which data stored on a CD-ROM 89 can be input into the coaching assistant apparatus 1 or data may be written onto a recordable CD-ROM.

The remote device interface 79 allows data to be input into and output from the coaching assistant apparatus 1 in the form of a signal 91. The remote device interface 79 allows either direct connection to a remote device or indirect connection via a computer network such as the internet.

The processor 81 performs processing operations in accordance with program routines stored in the program routine memory 85. These program routines may be either stored in the program routine memory 85 during manufacture, or input to the coaching assistant apparatus 1 via the operator interface 77 or the remote data interface 79. The program routines process sensor data received via the wireless communication apparatus 73, data input by the operator interface 77 and/or data input by the remote device interface 79 and store the resultant data in the database memory 83.

Figure 5:
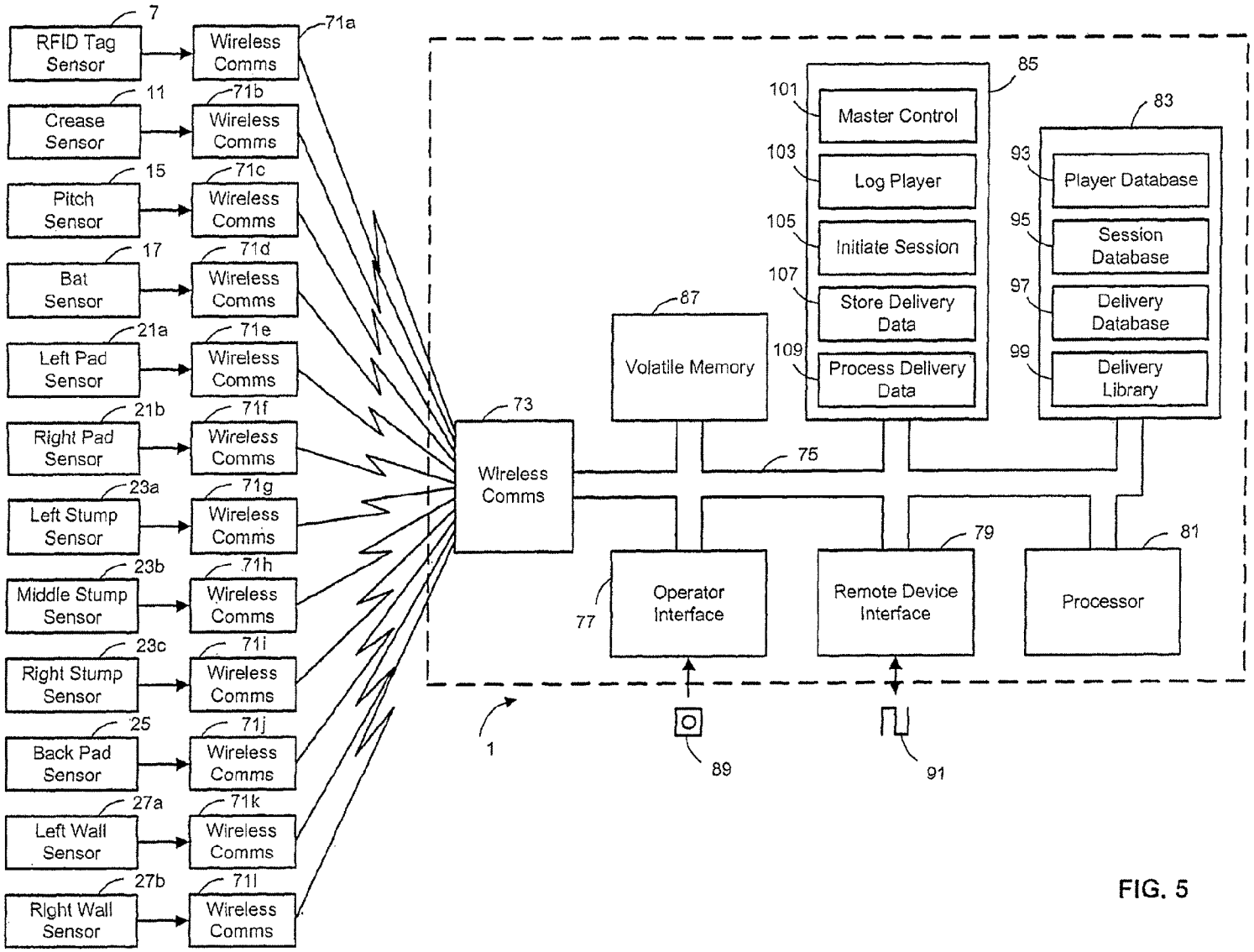
FIG. 5 is a schematic block diagram showing sensors and the main components of a coaching assistant apparatus forming part of the system illustrated in FIG. 1.

As shown in FIG. 5, the database memory 83 stores a player database 93, a session database 95, a delivery database 97 and a delivery library 99.

Figure 6:
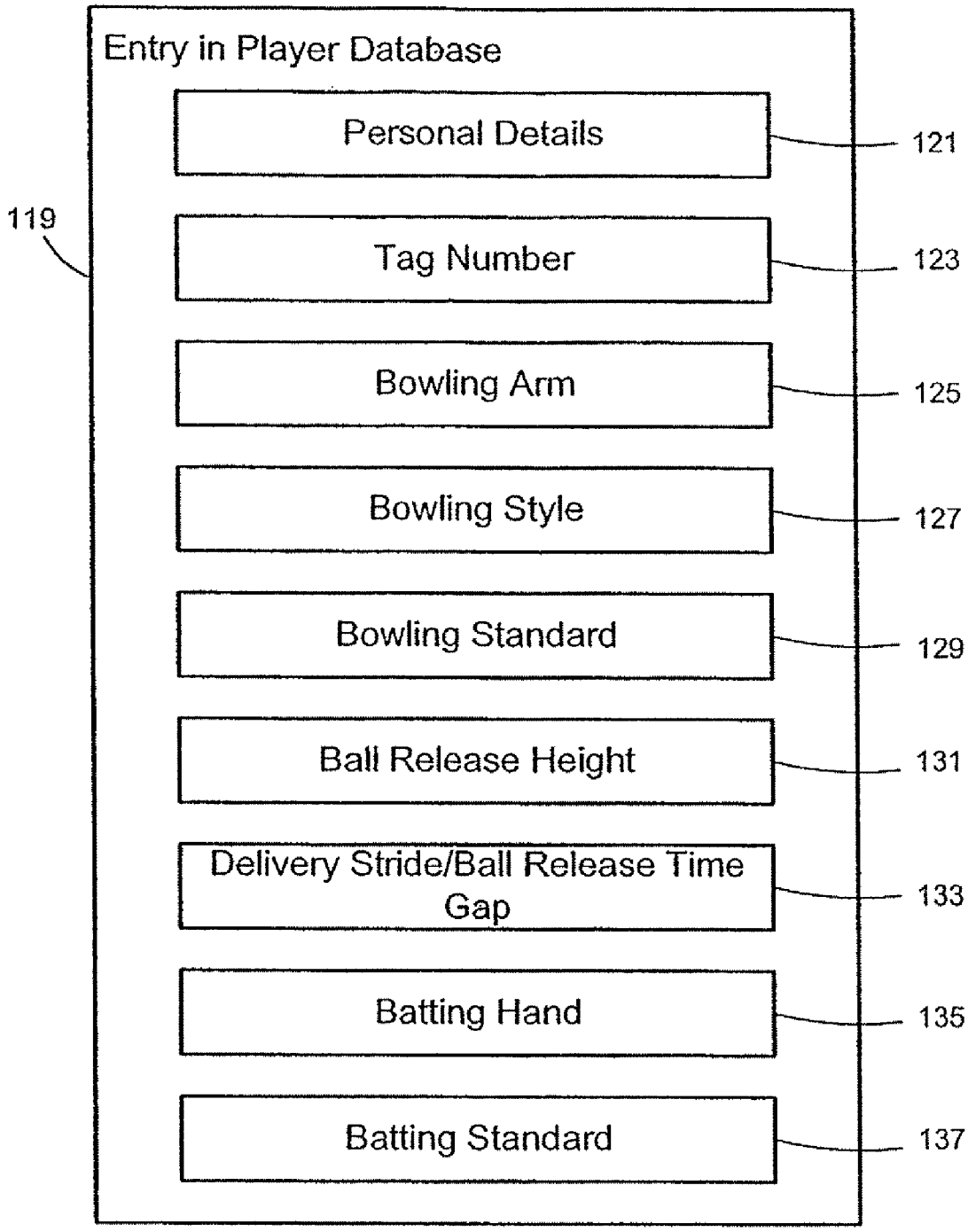
FIG. 6 is a schematic block diagram showing the configuration of data stored in an entry in a user database forming part of the coaching assistant apparatus illustrated in FIG. 1.

The player database 93 stores details for each player. As shown in FIG. 6, an entry 119 in the player database 93 stores:

- personal details including name, club (if appropriate), nationality, gender, date-of-birth and contact details;
- a tag number 123 for the RFID tag 7 associated with the player;
- bowling arm information 125 (left or right);
- bowling style information 127 (e.g. spin, medium-paced, fast-paced);
- bowling standard information 129;
- ball release height information 131 (i.e. the typical height of the ball above ground when released by the player during the bowling action);
- delivery stride/ball release time gap information 133 (i.e. the typical time between the player's front foot on delivery striking the pitch and the ball being released by the player during the bowling action);
- batting hand information 135 (left or right); and
- batting standard information 137.

Figure 7:
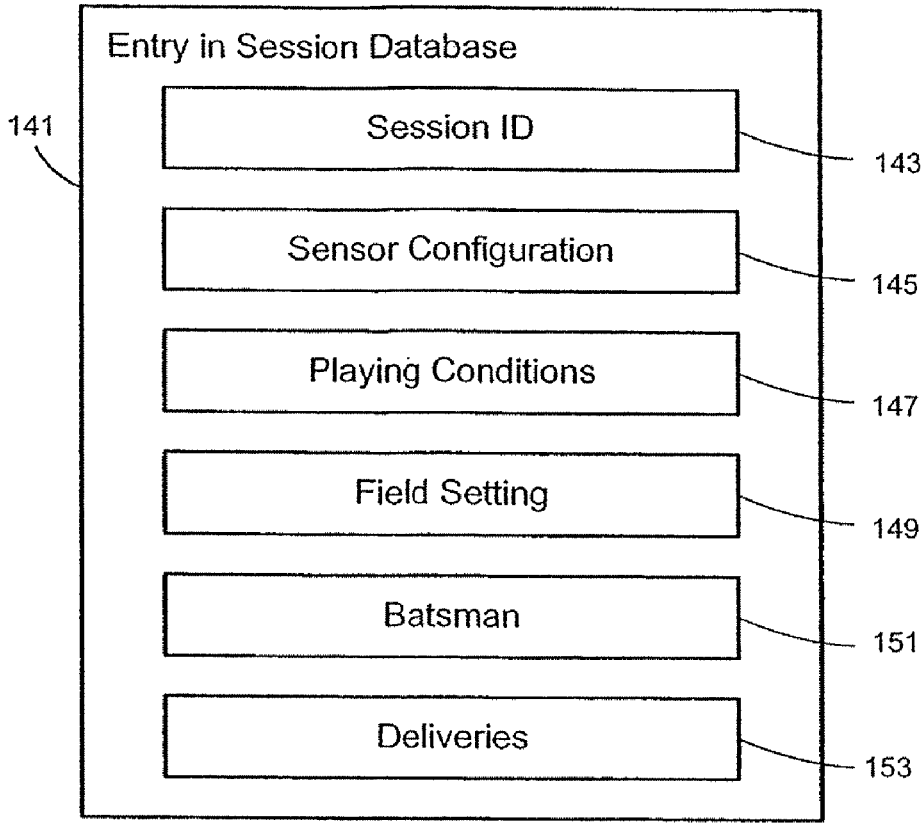
FIG. 7 is a schematic block diagram showing the configuration of data stored in an entry in a session database forming part of the coaching assistant apparatus illustrated in FIG. 1.

The session database 95 stores session data for each session. In this embodiment, each session is associated with a single batsman in the nets, or simple bowling practice with no batsman present. As shown in FIG. 7, an entry 141 in the session database 95 stores:

- a session identification number 143 which is unique to the session;
- sensor configuration information 145 indicating which sensors were present;
- playing conditions information 147 such as level of bounce of pitch and age of cricket ball;
- field setting information 149 for an imaginary field setting around the pitch;
- batsman information 151 identifying the batsman for the session, if one is present, or information about a type of batsman to be simulated; and
- deliveries information 153 storing a unique identification number for each delivery in the session so that the delivery data for the session may be identified.

Figure 8:
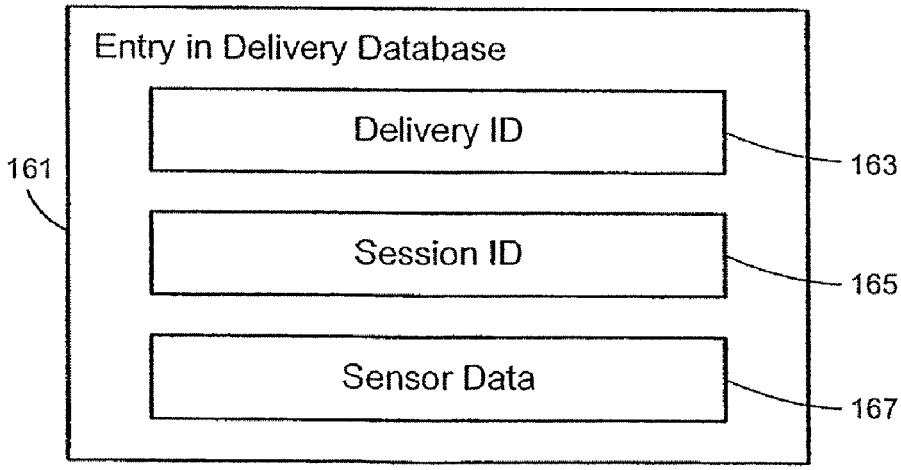
FIG. 8 is a schematic block diagram showing the configuration of data stored in an entry of a delivery data database forming part of the coaching assistant apparatus illustrated in FIG. 1.

The raw delivery data for the session is stored in the delivery database 97. As shown in FIG. 8, each entry 161 in the delivery database 97 stores:

- the unique delivery identification number 163 for the delivery;
- the unique session identification number 165 for the session in which the delivery took place; and
- sensor data 167 for the delivery.

The database memory 83 also stores a delivery library 99 which, as will be described in more detail hereafter, stores processed delivery data for deliveries recorded by the sensors.

In this embodiment, in order to facilitate data entry and integrity the data is stored in the database memory 83 using conventional relational database techniques.

As shown in FIG. 5, the program routines memory 85 stores a Master Control routine 101, a Log Player Routine 103, an Initiate Session routine 105, a Store Delivery Data routine 107 and a Process Delivery Data Routine 109. Each of these routines will now be discussed in detail.

Master Control Routine

The Master Control routine 101 controls the overall operation of the coaching assistant apparatus 1 by monitoring for interrupts indicating that a processing operation is required, and then initiating the processing operation. In particular: in response to the operator of the coaching assistant apparatus 1 selecting a "Log Player" option using the operator interface 77, the Master Control routine 101 initiates the Log Player routine 103; in response to the operator of the coaching assistant apparatus 1 selecting a "New Session" option using the operator interface 77, the Master Control routine 101 initiates the Initiate Session routine 105; and in response to the operator of the coaching assistant apparatus 1 selecting a "Process Delivery" option using the operator interface 77, the Master Control routine initiates the Process Delivery Data routine 109.

Log Player Routine

As mentioned above, the Log Player routine 103 is initiated in response to the operator of the coaching assistant apparatus 1 selecting a "Log Player" option. The Log Player routine 103 displays a series of questions about the new player, and the entered answers to these questions are used to form a new entry in the player database 93.

Initiate Session Routine

As mentioned above, the Initiate Session routine 105 is initiated in response to the operator of the coaching assistant apparatus 1 selecting a "New Session" option. The Initiate Session Routine 105 generates a unique session identification number and then displays a series of questions about the new session. The unique session identification number and the answers entered in response to the displayed questions are used to form a new entry in the session database 95. This includes information identifying which sensors are being used.

The Initiate Session routine 105 then awaits sensor data for the session. In response to receipt of sensor data by the wireless communication apparatus 73, the Initiate Session routine 105 initiates the Store Delivery Data routine 107 which stores the sensor data in the delivery database 97 as is described in more detail below.

The Initiate Session routine 105 ends in response to the operator of the coaching assistant apparatus selecting an "End Session" option using the operator interface 77.

Store Delivery Data Routine

In response to the receipt of sensor data by the wireless communication apparatus 73, the Store Delivery Data routine 107 generates a unique delivery identification number for the delivery, and then stores the unique delivery identification number together with the unique session identification number and the received sensor data as an entry in the delivery database 97.

It will be appreciated that not all the sensors will record a reading for each delivery. For example, only one of the back stop sensor 25 and the left and right wall sensors 27*a*, 27*b* will normally record a reading.

Process Delivery Data routine

As mentioned above, the Process Delivery Data routine 109 is initiated in response to the operator of the coaching assistant apparatus 1 selecting a "Process Delivery" option using the operator interface 77. When the "Process Delivery" option is selected, the Process Delivery Data routine 109 displays a request for the operator to select a session; once the operator has selected the session the Process Delivery Data routine 109 displays a request for the operator to select a delivery.

Figure 9:
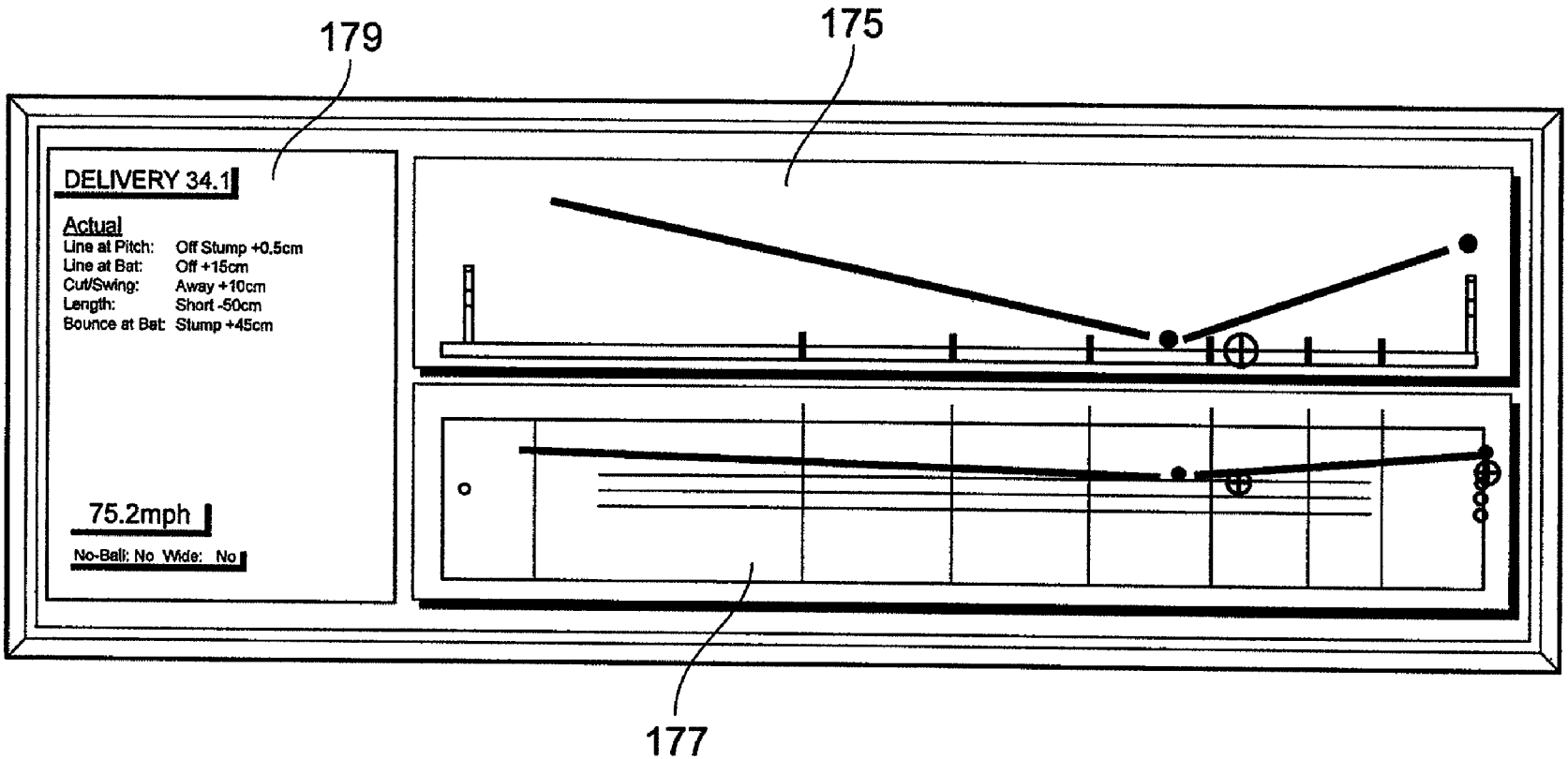
FIG. 9 shows an exemplary display of the coaching assistant apparatus illustrated in FIG. 5.

After a delivery has been selected by the operator of the coaching assistant apparatus 1, the Process Delivery Data routine 109 processes the sensor data to generate a graphical representation of the ball trajectory of the delivery, and then displays the graphical information together with analytical data. An exemplary display is shown in FIG. 9. The processed delivery data is also stored in the delivery library 99.

Initially, the Process Delivery Data routine 109 identifies the bowler for the delivery from the RFID Tag number detected by the RFID Tag sensor 7 and identifies the batsman, if there is one, from the entry in the session database for the session in which the delivery took place.

In general, the graphical representation of the ball delivery is generated by determining the position of the ball at three separate instants. These three separate positions will hereafter be referred to as the delivery position, the pitch impact position and the second impact position. The trajectory of the ball is interpolated from these three positions.

The delivery position is determined from the sensor reading on the crease sensor 11, which provides the lengthwise and widthwise co-ordinates with respect to the batting strip, and the Ball Release Height data 131 which provides the height co-ordinate above the batting strip. The pitch impact position is determined by sensor reading of the pitch sensor 15. The second impact position is determined by one of:

the position of the impact of the ball on the back stop sensor 25;

the position of the ball on one of the stump sensors 23;

the position of the ball on one of the pad sensors 21; and the position of the ball on the bat sensor.

From these three positions, the Process Delivery Data routine generates and displays a side view ball trajectory 175 and a top view ball trajectory 177.

It will be appreciated that for some deliveries the ball may not hit the pitch sensor 15, for example for a very full delivery where the ball pitches close to the batsman's crease. In this embodiment, if no impact on the pitch sensor is detected then the Process Delivery Data routine 109 displays a message indicating a graphical representation is not possible.

The Process Delivery Data routine 109 also determines the speed of the delivery based on the delivery position and the second impact position and their associated timings, and the delivery stride/ball release time gap data 133 stored in the entry for the bowler in the player database. In particular, the timing at the delivery position is modified by adding the delivery stride/ball release time gap to generate a delivery timing, and the speed is calculated from by dividing the distance between the delivery position and the second impact position by the difference between the delivery timing and the second impact timing. The speed of the delivery is displayed in an analytical data window 179 along with characteristic data for the delivery.

It will be appreciated that if the second impact position is on the bat sensor 17 or one of the pad sensors 21, then the second impact position can only be approximated because the batsman may move the bat or the pads and accordingly the trajectory and speed information will only be approximate.

In this embodiment, if the ball impacts the bat and one of the back stop sensor 25 and the left wall and right wall sensors 27*a*,27*b*, a result for the ball may also be given in dependence on the selected field setting for the session. For example, if the ball hits a position of the bat sensor 17 corresponding to the edge of the bat and then the back stop sensor 25, then depending on the position of impact on the back stop sensor 25 and the number of slip fielders in the field setting, it may be judged if the batsman is out caught behind or if the ball goes for four runs. Further, different regions of the left wall and right wall sensors 27 can be associated with fielders of the field setting so that if these portions are hit then no runs are scored, whereas if these positions are avoided then the number of runs scored may be determined in accordance with the magnitude of the impact on the wall sensor.

Second Embodiment

In the first embodiment, data characteristic of a ball delivery is generated. A second embodiment will now be described in which this characteristic data is used to recreate the ball delivery using an automated bowling machine.

This embodiment utilises a BOLA Cricket Bowling Machine, available from Stuart & Williams, 6 Brookfield Road, Cotham, Bristol, BS6 5PQ, UK. The BOILA Cricket Bowling Machine has a control panel via which speed, swing and spin for a delivery may be entered.

In this embodiment, the coaching assistant apparatus 1 of the first embodiment has an addition routine which, in response to an instruction from the operator, outputs the settings which need to be entered into the Cricket Bowling Machine for the speed, swing and spin in order to recreate the delivery.

Third Embodiment

In the second embodiment, the characteristic data for a ball delivery is used to calculate settings for a cricket bowling machine to recreate the delivery. In a third embodiment of the invention, the characteristic data for a ball delivery is processed to recreate the ball delivery virtually as part of a computer game. In this way, a real bowler may play against a virtual batsman.

There exists cricket computer games in which a player is able to control the bowling action using a joystick or the like, for example EA Sports Cricket 2005. In this embodiment, the coaching assistant apparatus processes the sensor readings to determine parameters which may be entered directly into such a computer game platform in place of joystick data in order to reproduce a recorded ball delivery.

Modifications and Further Embodiments

While a BOLA Cricket Bowling Machine was used in the second embodiment, it will be appreciated that alternative bowling machines could be used.

The ability to recreate a ball delivery using a bowling machine as described in the second embodiment opens up a large number of possibilities. For example, in one embodiment a bowler bowls a ball in one net without a batsman, the characteristic data for the ball delivery is processed to determine settings for a bowling machine, and these settings are transmitted to a remote location in which the bowling machine bowls the ball delivery to a batsman. In this way, a new cricket game in which a bowler "bowls" to a batsman in a separate locality may be played.

The coaching assistant apparatus may output the settings for a remote bowling machine either through the operator interface 77, relying on the operator to pass the settings on, or more preferably via the remote device interface 79 directly to the remote bowling machine.

While the ElekTex cloth sensor is used for the impact sensors in the illustrated embodiments, other forms of impact sensor could be used. For example, the pad sensor described in U.S. Pat. No. 6,788,295 could be used. Alternatively, a simple array of pressure sensors could be used with processing electronics associating each of the array of pressure sensors with an associated position.

In the illustrated embodiments, separate crease and pitch sensors are provided. Alternatively, the crease and pitch sensors could be integrally formed to form an elongate strip the entire length of the wicket. Advantageously, the elongate strip could have wicket markings such as the popping crease marked thereon to allow a wicket to be formed by simply unrolling the elongate strip.

Preferably, the RFID Tag Sensor and the crease sensor could be integrated into a single sensing system, sharing common processing electronics and wireless communication apparatus. In this way, when the crease sensor sensing the front foot impact of a bowler the RFID tag sensor is instructed to identify the closest RFID tag in order to identify the bowler. The RFID tag number and sensor data from the crease sensor are then sent together to the coaching assistant apparatus.

The RFID tag sensor is not essential if alternative means for identifying the bowler are present, or the bowler identity is not required. For example, if only one bowler is bowling or a group of bowlers are bowling in strict rotation then bowler information could be entered directly into the coaching digital assistant.

Although separate stump sensors are provided for each stump in the illustrated embodiment, alternatively a single sensor could be formed as a sleeve around all three stumps. This would have the advantage of reducing the number of sensors and wireless communication apparatuses.

In the illustrated embodiment, the pad sensors are wrapped around the cricket pads. As the pad sensors are made of cloth, it will be appreciated that the pad sensors could be built directly into the cricket pads.

In the first embodiment, the back stop sensor and the left and right wall sensors are hung from a frame in place of conventional nets. For safety reasons, it may be desirable to hang nets in addition to the back stop sensor and left and right wall sensors, particularly close to the batsman's crease.

It will be appreciated that additional sensors could be utilised to provide even more information relating to a delivery. For example, an impact sensor could be provided on the ground by the stumps to the impact of full pitch deliveries and also to monitor the movement of the feet of the batsman. In this case, the processing electronics includes pattern matching software to differentiate between the distinctive impacts of the cricket ball and the feet of the batsman.

In the first embodiment, the sensors are synchronised by a synchronisation signals transmitted using wireless communication. Alternatively, the sensors may be synchronised using a calibration procedure in which two or more sensors receive simultaneous impacts to provide synchronous timing information, and then other sensors are grouped with respective ones of the synchronised sensors and the process repeated until all sensors have been synchronised.

In the illustrated embodiments, data is communicated from the sensors to the coaching assistant apparatus using wireless data transfer in accordance with the Bluetooth protocol. It will be appreciated that other forms of data transfer could be used. Further, wire communication links could replace the wireless communication links. In this respect, the wired communication links could be formed by cloth wires which are provided with the ElekTex cloth sensors. The use of such cloth wires is desirable because of their portability and simple deployment properties.

As described in the first embodiment, the operator interface of the coaching assistant apparatus may have a keyboard for entering data and a display for displaying sensor. Other forms of man-machine interface are possible. For example, the coaching assistant apparatus may have a touch-sensitive screen of the type used by many personal digital assistants (PDAs).

In the first embodiment, the coaching assistant apparatus provides views of a ball delivery trajectory from the side and from above. It will be appreciated that other views of the ball delivery trajectory could be presented, for example from behind the batsman's wicket. In an embodiment, the operator may select any desired orientation for viewing the ball delivery trajectory.

In the embodiments described above, a coaching assistant apparatus is provided which allows onsite analysis of the sensor readings. Alternatively, the sensor readings could be simply stored onsite and then transferred to a remote processing apparatus for analysis. The remote processing apparatus could be a convention personal computer running customised software for performing the analysis. Alternatively, the sensor readings could be uploaded to a website for processing.

It will be appreciated that a single coaching assistant apparatus could collate and analyse data from several sets of sensors, each corresponding to a different batting strip. In this way, a coach may centrally monitor the amount of time spent batting by each player, the number of balls delivered by each player and the like. In an embodiment, the coaching assistant apparatus gives an alert to the coach under predetermined conditions, e.g. that a batsman has been bowled out or that no ball has been delivered in one batting strip for a predefined period of time. The coach would also be able to filter data to compare, for example, different fast bowlers or different specialist batsmen.

While the invention has been described in relation to a cricket game, it will be appreciated that the invention may also be applied to other forms of ball games such as tennis, squash and the like.

Although the described embodiment of the invention comprises computer apparatus and processes performed in the computer apparatus, the invention also extends to computer programs, particularly computer programs on or in a carrier, adapted for putting the invention into practice. The program may be in the form of source code, object code, a code intermediate source and object codes such as in a partially compiled form, or in any other form suitable for using the implementation of the processes according to the invention.

The carrier may be any entity or device capable of carrying the program. For example, the carrier may comprise a storage medium, such as a ROM, for example a CD-ROM or a semiconductor ROM, or a magnetic recording medium, for example a floppy disk, or a hard disk. Further, the carrier may be a transmissible carrier such as an electronic or optical signal which may be conveyed via electrical or optical cable or by radio or other means.

When the program is embodied in a signal which may be conveyed directly by cable or other device or means, the carrier may be constituted by such cable or other device or means. Alternatively, the carrier may be an integrated circuit in which the program is embedded, the integrated circuit being adapted for performing, or for use in the performance of, the relevant processes.

Although in the described embodiments the invention is implemented using software, it will be appreciated that alternatively the invention could be implemented using hardware devices, or a combination of hardware devices and software.

The invention claimed is:

1. An apparatus for playing a sport game in which a bowler situated at a bowling location delivers a ball to a batter situated at a batting location, the apparatus comprising:

a first impact sensor disposed at the bowling location and operable to provide first impact data relating to the time and position on the first impact sensor of an impact caused by the bowler contacting the first impact sensor;

a plurality of additional impact sensors positioned in proximity to the sport game, each additional impact sensor being operable to provide second impact data relating to the time and position on the additional impact sensor of an impact caused by the ball on the additional impact sensor; and a processor coupled to the first impact sensor and to the plurality of additional impact sensors by a communications link, wherein the processor is operable to:

determine a ball delivery position on the basis of the first impact data from the first impact sensor; and derive data indicative of the movement of the ball on the basis of the determined ball delivery position and the second impact data from at least one of the additional impact sensors.

2. An apparatus according to claim 1, wherein at least one of the impact sensors comprises a planar sensor.

3. An apparatus according to claim 2, wherein said at least one impact sensor comprises at least two conductive layers separated by a central layer which allows conduction between the conductive layers when compressed.

4. An apparatus according to claim 1, further comprising an RFID sensor operable to detect an RFID tag carried by a player.

5. An apparatus according to claim 1, wherein the communications link comprises a wireless communication link.

6. An apparatus according to claim 5, wherein the wireless communication link is operable to transfer data using a bluetooth protocol.

7. An apparatus according to claim 1, wherein the processor is operable to generate data for displaying a graphical representation of the trajectory of the ball using impact data from at least two impact sensors.

8. An apparatus according to claim 1, wherein the processor is operable to process impact data from at least two of the impact sensors to calculate speed information for the movement of the ball.

9. An apparatus according to claim 1, wherein the processor is operable to calculate input parameters for an automatic ball delivery machine to enable reproduction of a ball trajectory.

10. An apparatus according to claim 1, wherein the processor is operable to calculate input parameters for a computer program to enable virtual reproduction of a ball trajectory by the computer program.

11. An apparatus according to claim 1, wherein the sport game is cricket.

12. An apparatus according to claim 11, wherein at least two of the impact sensors comprise mats operable to be positioned on a cricket pitch.

13. An apparatus according to claim 11, comprising a mat operable to define a cricket pitch having at least one impact sensor embedded therein.

14. An apparatus according to claim 11, wherein at least one of the additional impact sensors is mounted on a conventional cricket bat.

15. An apparatus according to claim 11, wherein at least one of the additional impact sensors is mounted on a conventional cricket pad.

16. An apparatus according to claim 11, wherein at least one of the additional impact sensors is mounted to one or more cricket stumps.

17. An apparatus according to claim 11, wherein at least one of the additional impact sensors is mounted to a cricket nets frame.

18. An apparatus according to claim 11, wherein the plurality of additional sensors includes a second impact sensor disposed between the bowling and the batting locations.

19. A method of analyzing the movement of a ball during a sport game in which a bowler situated at a bowling location delivers a ball to a batter situated at a batting location, the method comprising:

receiving first impact data from a first impact sensor disposed at the bowling location and operable to provide impact data relating to the time and position on the impact sensor of an impact caused by the bowler contacting the first impact sensor;

receiving second impact data from one or more of a plurality of additional impact sensors, each additional impact sensor being operable to provide impact data relating to the time and position on the impact sensor of an impact caused by the ball on the additional one or more impact sensors;

processing the first impact data from the first impact sensor to determine a ball delivery position; and processing the second impact data from at least one of the additional impact sensors to derive data indicative of the movement of the ball on the basis of the determined ball delivery position and the second impact data from said at least one of the additional impact sensors.

20. A method according claim 19, wherein the processing step comprises generating data for displaying a graphical representation of the trajectory of the ball using impact data from the first impact sensor and at least one of the additional impact sensors.

21. A method according to claim 19, wherein the processing step comprises processing impact data from at least two of the impact sensors to calculate speed information for the movement of the ball.

22. A method according to claim 19, wherein the processing step comprises calculating input parameters for an automatic ball delivery machine to enable reproduction of a ball trajectory.

23. A method according to claim 19, wherein the processing step comprises calculating input parameters for a computer program to enable virtual reproduction of a ball trajectory by the computer program.

24. A method according claim 19, wherein the plurality of additional impact sensors includes a second impact sensor disposed between the bowling and the batting locations.

25. A non-transitory storage device storing instructions including instructions for programming a programmable processing apparatus to implement a method of analyzing the movement of a ball during a sport game in which a bowler situated at a bowling location delivers a ball to a batter situated at a batting location, the method comprising:

receiving first impact data from a first impact sensor disposed at the bowling location and operable to provide impact data relating to the time and position on the impact sensor of an impact caused by the bowler contacting the first impact sensor;

receiving second impact data from one or more of a plurality of additional impact sensors, each additional impact sensor being operable to provide impact data relating to the time and position on the impact sensor of an impact caused by the ball on the additional one or more impact sensors;

processing the first impact data from the first impact sensor to determine a ball delivery position; and processing the second impact data from at least one of the additional impact sensors to derive data indicative of the movement of the ball on the basis of the determined ball delivery position and the second impact data.

* * * * *